US012490801B2

(12) United States Patent
Conklin et al.

(10) Patent No.: US 12,490,801 B2
(45) Date of Patent: Dec. 9, 2025

(54) ENERGY STORAGE AND RELEASE SOLE STRUCTURE

(71) Applicant: adidas AG, Herzogenaurach (DE)

(72) Inventors: Sam Conklin, Portland, OR (US); Iain Hannah, Portland, OR (US); Matteo E. Padovani, Portland, OR (US); Reuben Bligh, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/670,400

(22) Filed: May 21, 2024

(65) Prior Publication Data

US 2025/0359624 A1 Nov. 27, 2025

(51) Int. Cl.
*A43B 13/18* (2006.01)

(52) U.S. Cl.
CPC ..... *A43B 13/18* (2013.01); *A43B 13/183* (2013.01); *A43B 13/186* (2013.01)

(58) Field of Classification Search
CPC ..... A43B 13/18; A43B 13/183; A43B 13/186
USPC ..... 36/28
See application file for complete search history.

(56) References Cited

U.S. PATENT DOCUMENTS 3,039,207 A * 6/1962 Lincors ..... A43B 13/18 36/58.5
4,756,095 A * 7/1988 Lakic ..... A43B 13/18 36/2.6
5,517,769 A * 5/1996 Zhao ..... A43B 13/18 36/7.8
6,397,496 B1 * 6/2002 Seymour ..... A43B 13/18 482/79
7,950,166 B1 * 5/2011 Perenich ..... A43B 13/182 36/31
10,448,702 B2 * 10/2019 Farris ..... A43B 13/181
10,743,613 B2 * 8/2020 Farris ..... A43B 13/20
2013/0340287 A1 * 12/2013 Stewart ..... A63B 21/152 36/103
2014/0000125 A1 * 1/2014 Butler ..... A43B 13/181 36/43
2016/0302521 A1 * 10/2016 Rennex ..... A43B 13/184
2017/0273398 A1 * 9/2017 Butler ..... A43B 7/141
2020/0378462 A1 * 12/2020 Rennex ..... A43B 13/183

OTHER PUBLICATIONS

European Patent Application No. 25177539.1, Extended European Search Report, Sep. 29, 2025, 9 pages.

* cited by examiner

*Primary Examiner* — Marie D Bays
(74) *Attorney, Agent, or Firm* — Kilpatrick Townsend & Stockton LLP

(57) ABSTRACT

A sole structure for a shoe is provided with a regenerative midsole having an energy storage and release device is provided with a leaf spring assembly movable between a first unloaded position and a second loaded position. A locking linkage cooperates with the leaf spring assembly to lock the leaf spring assembly in the second loaded position. The locking linkage cooperates with the leaf spring assembly so that as the locking linkage is moved to a locked position, the leaf spring assembly is moved to the second loaded position. A trigger is connected to the locking linkage. Actuation of the locking linkage based on a wearer input releases the locking linkage to an unlocked position and allows the leaf spring assembly to move to the first unloaded position and thereby return stored energy to the wearer.

20 Claims, 5 Drawing Sheets

ENERGY STORAGE AND RELEASE SOLE STRUCTURE

TECHNICAL FIELD

The present application relates to sole structure for shoes having a device to selectively release stored energy.

BACKGROUND

Footwear typically includes an upper and a sole. The shoe upper secures the shoe to the wearer's foot and may be made of leather, and/or synthetic materials to comfortably cover the wearer's foot and provide protection and ventilation. The sole is the part of the shoe that sits below the wearer's foot. In athletic footwear in particular, the sole may be constructed of several layers such as an insole, a midsole, and an outsole.

The midsole is a layer between the insole and the outsole and typically forms the middle layer of the sole structure. The midsole is typically formed of a resilient foam material that helps typically provide extra energy absorption and ground reaction force attenuation in athletic shoes.

SUMMARY

In one or more embodiments, a sole structure for a shoe is provided with a regenerative midsole. The regenerative midsole includes an energy capture mechanism positioned in a heel region and is elastically deformable under pressure of a heel-strike by the wearer. A connector extends from the energy capture mechanism to translate the energy captured in the heel region. An energy storage and release device is positioned in a forefoot region and connected to the connector. The energy storage and release device has a leaf spring assembly movable between a first expanded position and a second compressed position. An over-center linkage is connected to the leaf spring assembly and the linkage movable between an unlocked position and a locked position in which linkage arms are positioned over-center. The over-center linkage moves the leaf spring assembly to the compressed position as linkage is moved to the locked position. A trigger is connected to the over-center linkage. Actuation of the trigger based on a wearer input releases the over-center linkage to the unlocked position and allows the leaf spring assembly to move to the first expanded position and thereby return stored energy to the wearer.

In one or more embodiments, the leaf spring assembly has a pair of leaf springs that are oriented opposite and flexed apart in the expanded position. The pair of leaf springs compress towards each other in the second compressed position.

In one or more embodiments, the over-center linkage has a first linkage arm connected to pivot at a first end of the pair of leaf springs, and a second linkage arm is connected to pivot at the second end of the pair of leaf springs. In the over-center locked position the first and second linkage arms abut at center ends.

In one or more embodiments, the center ends of the first and center linkage arms have an angled abutment face that has an angle being less than 90-degrees relative to a longitudinal axis of the first and second linkage arms.

In one or more embodiments, a sole structure of a shoe has an energy capture mechanism positioned in a first midsole region. The energy capture mechanism is elastically deformable under the pressure of a foot-strike by the wearer. A connector extends from the energy capture mechanism element to translate the energy captured in the first midsole region to a second midsole region different than the first midsole region. An energy storage and release device is positioned in the second midsole region and connected to the connector. The energy storage and release device has a storage element movable between a first unloaded position and a second loaded position. A locking element cooperates with the storage element to lock the storage element in the second loaded position. The connector cooperates with the locking element and moves the storage element from the first unloaded position to the second loaded position when the energy capture element is deformed. Actuation of the locking element based on a wearer input releases the storage element to return stored energy to the wearer.

In one or more embodiments, the storage element has at least one spring. In one or more embodiments, the spring includes a pair of leaf springs, wherein the pair of leaf springs are joined at each of two ends. In one or more embodiments, the storage element has two pairs of leaf springs.

In one or more embodiments, the locking element comprises an over-center linkage. In one or more embodiments, the over-center linkage includes a pair of arms connected to pivot relative to each other. The pair of arms pivot to an over-center locked position to maintain the storage element in the second loaded position. In the locked position, a longitudinal axis of the arms are oriented at an angle greater than 180-degrees. In one or more embodiments, the linkage arms and the leaf springs rotate about a common pivot point axis at ends. The first and second linkage arms are connected at a central pivot point adjacent the center ends and oriented as mirror images. In one or more embodiments, the pair of linkage arms are shorter than a length of the leaf spring.

In one or more embodiments, the locking element has a trigger element that is actuated by an input from the wearer. In one or more embodiments, the trigger element includes a protrusion extending from at least one of the first and second linkage arm. In one or more embodiments, the protrusion extends through an outsole of the sole structure to contact the ground and actuate the locking element based on input by the wearer.

In one or more embodiments, the trigger element moves the locking element from the locked position to an unlocked position based on input from the wearer. In one or more embodiments, the input from the wearer includes at least one of a foot angle, a bending angle of a portion of the wearer's foot, an engagement time or an engagement time.

In one or more embodiments, when the trigger element is actuated, the storage element is moved to the first unloaded position, transferring the energy to the wearer.

In one or more embodiments, the connector comprises a cable extending between the energy capture device in the first midsole region and the locking element in the forefoot region.

In one or more embodiments, a sole structure having an energy storage and release device is provided with a leaf spring assembly movable between a first unloaded position and a second loaded position. A locking linkage cooperates with the leaf spring assembly to lock the leaf spring assembly in the second loaded position. The locking linkage cooperates with the leaf spring assembly so that as the locking linkage is moved to a locked position, the leaf spring assembly is moved to the second loaded position. A trigger is connected to the locking linkage. Actuation of the locking linkage based on a wearer input releases the locking linkage to an unlocked position and allows the leaf spring assembly to move to the first unloaded position and thereby return stored energy to the wearer.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
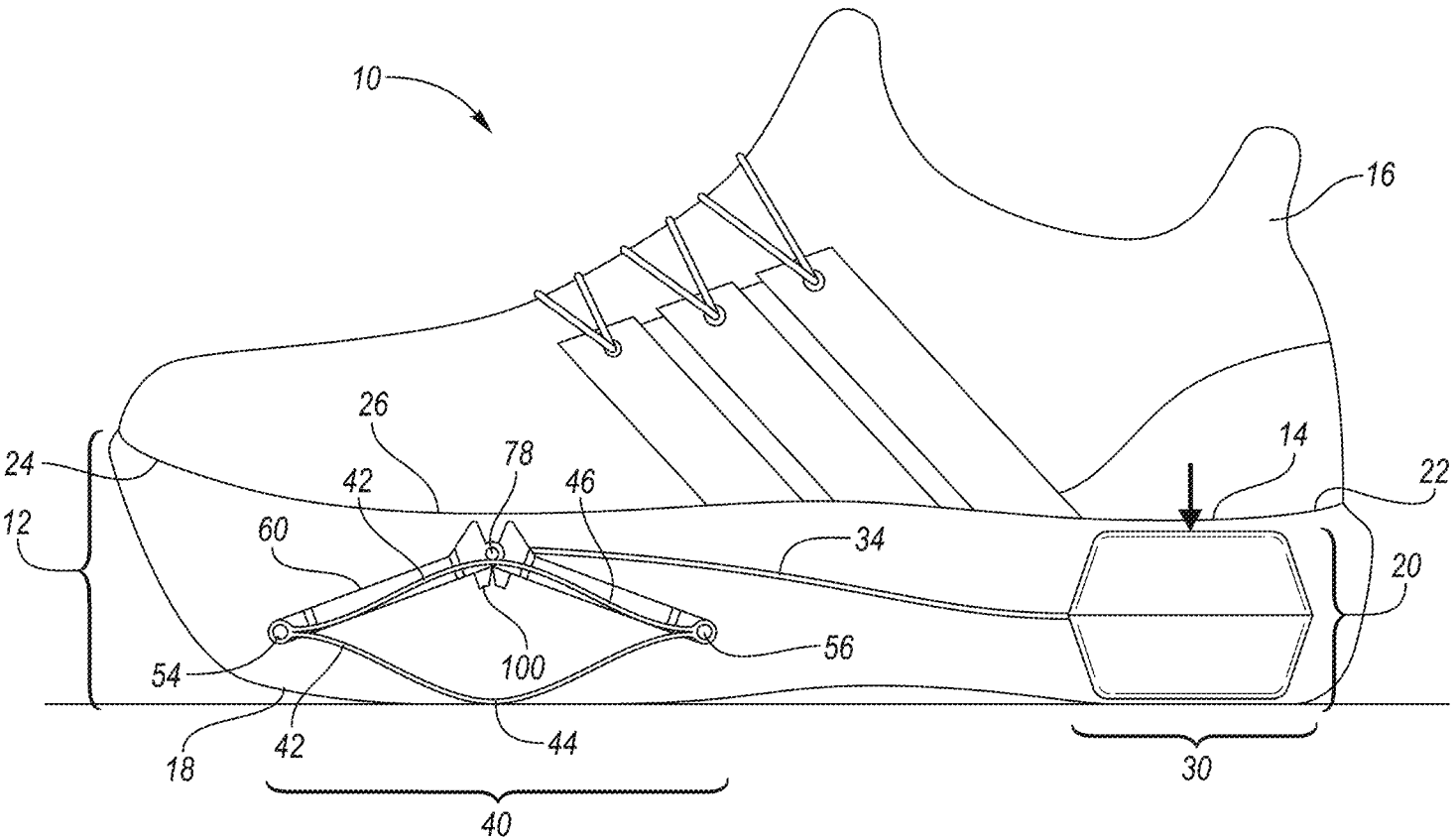
FIG. 1 illustrates a side view of footwear showing a schematic view of a sole structure according to one embodiment, where the sole structure is in a first position.
Figure 2:
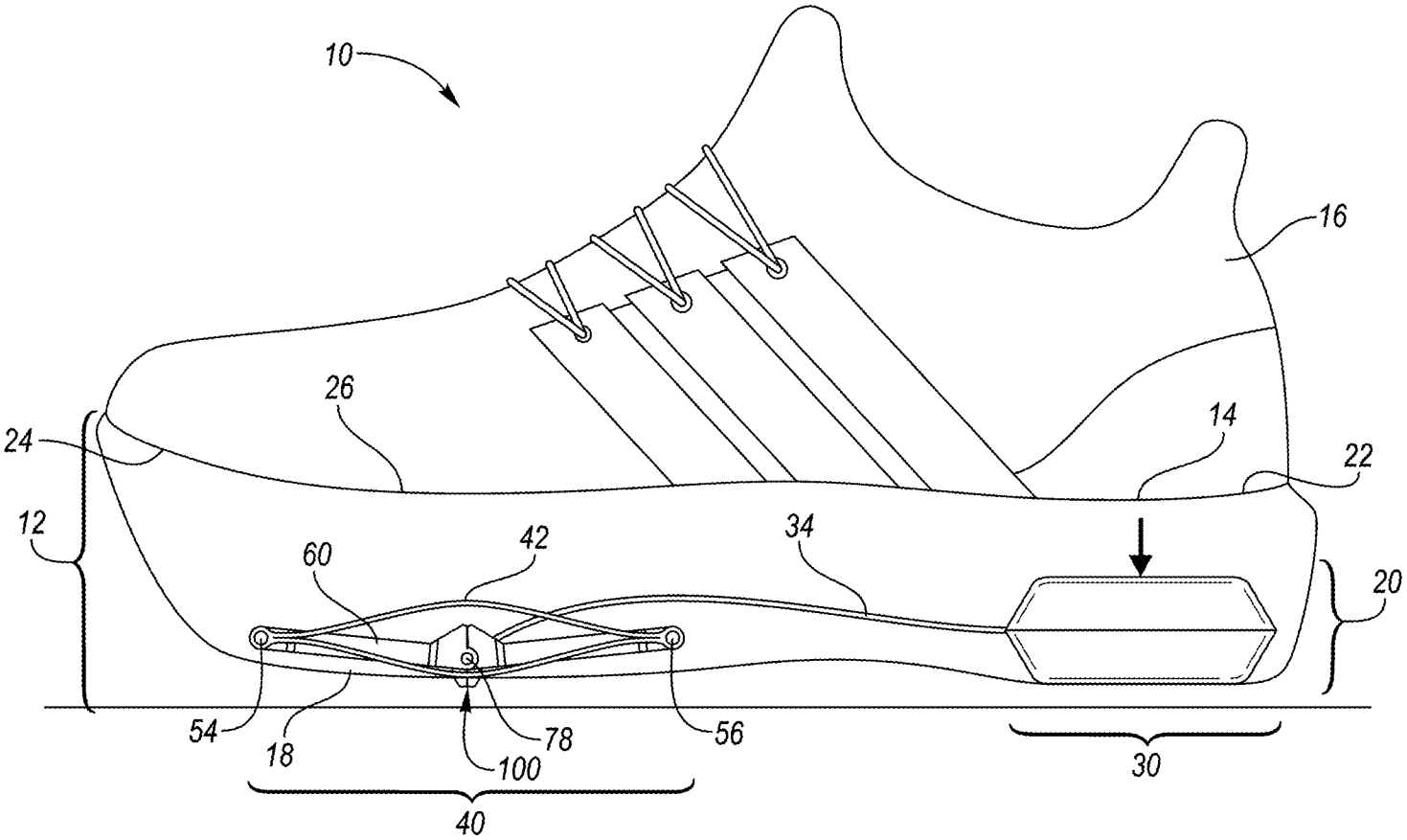
FIG. 2 illustrates a side view of the footwear in FIG. 1 and the schematic view of the sole structure, where the sole structure is in a second position.

FIGS. 1-2 illustrates a schematic view of a shoe 10 having a sole structure 12 including a regenerative energy midsole structure 20 according to one embodiment. The schematic view in FIG. 1 shows a cut-way view of the sole structure with the outer materials removed to illustrate the regenerative energy midsole structure 20 in greater detail. The midsole structure 20 extends to provide support to the wearer's foot from the heel region 22 to the toe region 24. The sole structure 12 may also include an insole 14 contoured to specifically support to the user's arch, for example. The sole structure 12 may also include an outsole 18 along a bottom surface of the midsole structure 20. The outsole 18 forms the outer exposed part of the sole structure 12 that comes into contact with the ground and includes the tread design. The sole structure 12 may then be attached to a shoe upper 16 to form the shoe and footwear. For example, the shoe upper 16 can be attached to an upper surface of the midsole structure 20. The midsole structure 20 may also include foam or other supportive cushion material not shown in this schematic view.

While the midsoles may provide some support, such as arch support or to prevent movement such as pronation, typically, the midsole structure is formed of cushioning foam and gels to dissipate impact energy. For example, the midsole may provide a user with increased cushioning in a heel region to absorb energy and attenuate ground reaction when landing on the heel while running. Some running shoes may use foams with higher resilience that dissipate less energy or plates that will return some energy. However, these shoes are not able to return the energy at a specific time or location.

FIGS. 1-2 illustrate the shoe 10 having the regenerative energy midsole structure 20 that captures energy and allows the energy stored and to be returned when required. The midsole structure 20 has an energy capture mechanism 30 that captures energy when the wearer's foot strikes the ground. This energy is normally lost, but the device returns the energy when triggered. An energy storage and release device 40 is "charged" when the wear's foot strikes the ground. The energy is then moved from the energy capture mechanism 30 and stored in the energy storage and release device 40 until triggered. Triggering of the device 40 releases the energy to the wearer when they push off on the forefoot. For example, the device 40 may return the energy to a runner during the propulsive phase of gait. Most athletes strike the ground first with their heel or rearfoot, and so the energy capture mechanism 30 would be positioned in the heel region 22 of the sole structure 12, as show in FIGS. 1-2. The energy captured at the rearfoot is then moved to the forefoot and stored until triggered. However, some athlete's strike the ground with their midfoot or even their forefoot and the energy capture mechanism 30 could be positioned at any suitable position between the heel region 22 and the toe region 24 to accommodate the athlete's specific requirements or uses. No footwear material, even the most advanced midsole materials, can return 100% of the energy put into them, there will always be a loss of energy. The midsole structure 20 of the present application stores energy when the wearer's foot strikes the ground and then releases that energy during takeoff. The goal is to increase energy return to closer to 100% or even over 100% by transferring energy captured from the foot strike at a first region of the midsole structure 20 and using the energy to increase energy return during takeoff at a second region, different than the first region. For example, capturing the energy at the heel strike can increase the forefoot energy return and can provide additional propulsion to the runner and reduce the energetic cost of running. There are potential additional benefits at the foot strike region to damp/absorb the impact by the system, which may lessen high-impact stresses or injuries, for example.

In one embodiment, as shown in FIGS. 1-2, the energy capture mechanism 30 can be positioned in the heel region 22. However, in other various embodiments, the energy capture mechanism 30 can be positioned in any area of the midsole structure 20 where a runner first touches the ground. For example, the energy capture mechanism 30 can be positioned in a midfoot region to capture energy from midfoot strikers and/or can be positioned in the forefoot region 24 to capture energy from forefoot strikers. The energy capture mechanism 30 can be elastically deformable under the pressure of a ground-strike by the wearer. For example, the energy capture mechanism 30 can deform to harness the energy of the runner during touchdown.

The midsole structure 20 can also include a connector 34 extending between the energy capture mechanism 30 and the energy storage and release device 40. The connector 34 can allow the displacement in the midsole structure 20 to be converted to a direction that can be exploited by the energy storage and release device 40 in the forefoot region 26. The energy capture mechanism 30 may be or include a pantograph mechanism, a bell crank, straight-line linkages, for example, and/or any other similar device that receives the generally vertical displacement in the midsole structure 20 and converts it to a motion by the connector 34.

The connector 34 is an element that translates the energy captured by the energy capture mechanism 30 positioned in one region of the sole structure to translate the energy to a different region. In one embodiment shown in FIGS. 1-2, the connector 34 translates the energy capture in the heel region 22 to the energy storage and release device 40 positioned in the forefoot region 26. For example, the connector 34 can be used to convert the vertical deformation captured by the energy capture mechanism 30 to horizontal motion for use with energy storage and release device 40. The connector 34 may be or include a cable, cable and housing, pushrod, pushrod and housing, a linkage or bar that moves in a generally linear direction. For example, the energy capture mechanism 30 may pull on a cable. The vertical deformation by the energy capture mechanism 30 may also be converted to rotational motion, such as a rotating driveshaft, rocker or pulley, for example.

The energy storage and release device 40 may include a storage element 42 that is movable between a first unloaded position and a second loaded position. The storage element 42 stores the energy collected in the heel 22 until it is released in the forefoot 26. The storage element 42 may be or include a spring such as a coil spring, Bellville spring, wave spring, torsion spring, leaf spring, or any other suitable spring or shape that can elastically compress to store energy, and then exert a return force when extended. The energy storage and release device 40 may also be or include pressurized fluid, compressed air disposed in cylinders, a flywheel, and/or a battery/capacitor.

As illustrated in FIGS. 1-8, the storage element 42 may be or include a spring assembly. In various embodiments, the spring assembly may have one or more leaf springs 41, or one or more pairs of leaf springs 41. In one embodiment, as illustrated in FIGS. 1-8, the spring assembly may have two pair of leaf springs. Each pair of leaf springs can include a first leaf spring 44 (e.g., a lower leaf spring) and a second leaf spring 46 (e.g., an upper leaf spring). In various embodiments, the leaf springs 44, 46 can be made of thin, arced strips of steel (e.g., spring steel) that are able to flex and return to their original shape, allowing the stored energy to be released when the load is reduced or removed. The leaf springs 44, 46 can additionally or alternatively be made of polymer or composite materials, or any suitable spring material. The individual leaf springs 44, 46 flex and deform toward each other. As the leaf springs 44, 46 compress to the second loaded position, potential energy is stored. The deformation of the springs represents the work done to compress them.

Figure 7:
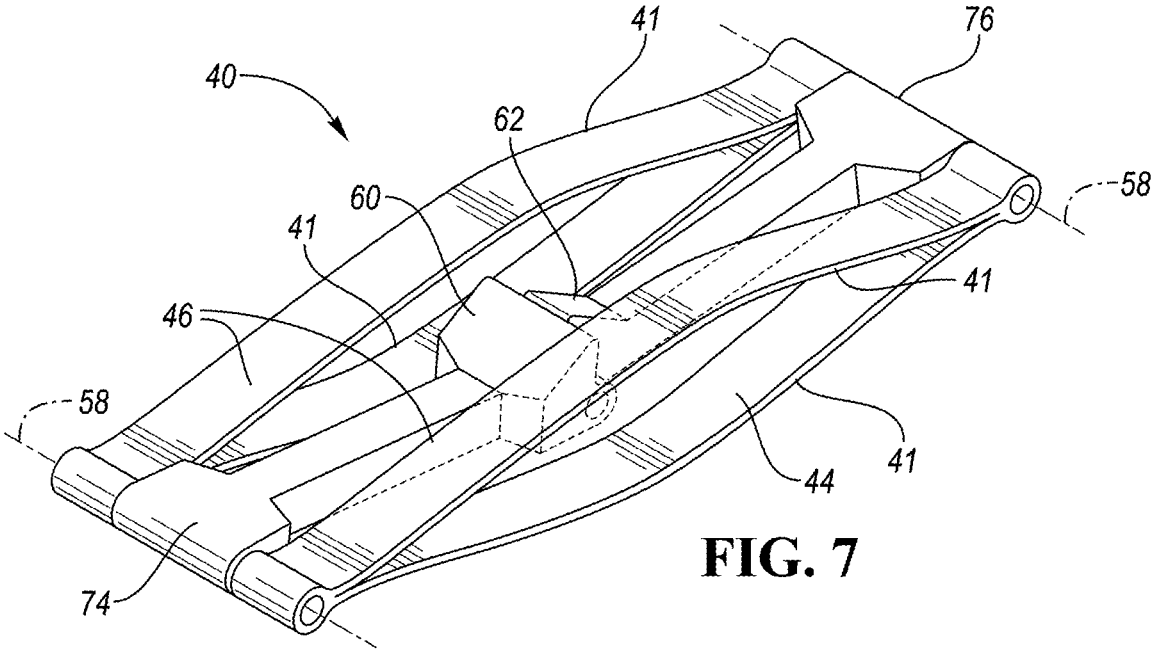
FIG. 7 illustrates a front-side perspective view of the energy storage and release device in FIG. 3, where the device is in a second position.
Figure 8:
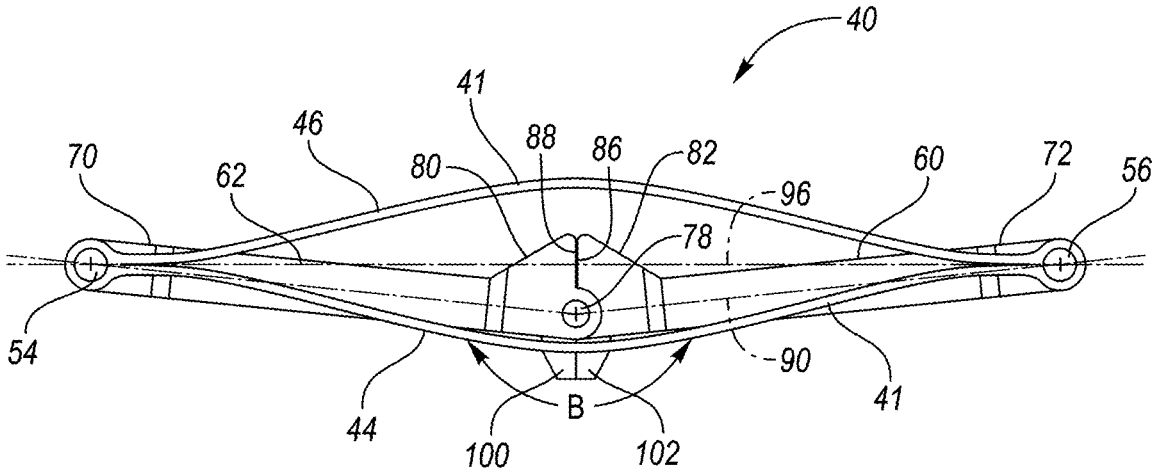
FIG. 8 illustrates a side perspective view of the energy storage and release device in FIG. 7, where the device is in the second position.

The first and second leaf spring 44, 46 are joined at attachment points 54, 56. As shown in FIGS. 1 and 2, the attachment point 54 may be a forward end and attachment point 56 may be a rearward end, however the first and second leaf springs 44, 46 may be positioned in other orientations within the sole structure 12. The attachment points 54, 56 may be fixed or pivot to allow for movement. The attachment points 54, 56 are connected to a locking element 60 of the energy storage and release device 40. The connector 34 cooperates with the locking element 60 to move the energy storage element 42 from the first unloaded position (FIGS. 1, 3 and 4) to the second loaded position when the energy capture mechanism 30 is deformed (FIGS. 2, 7 and 8).

Figure 3:
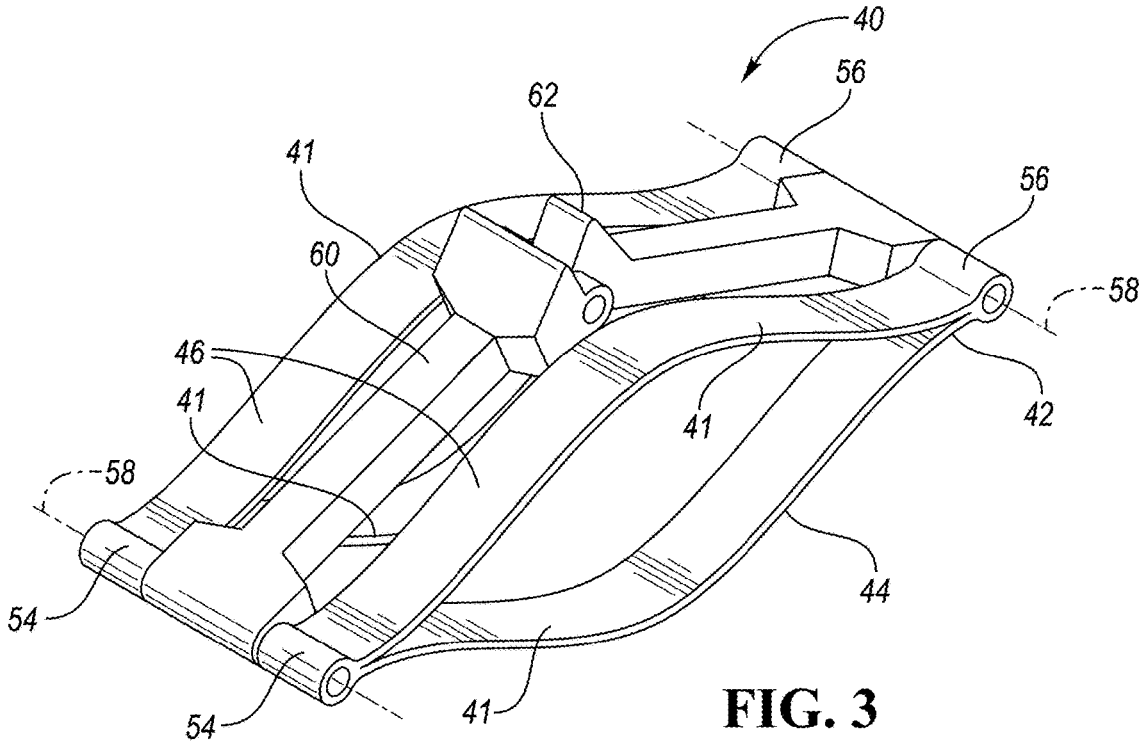
FIG. 3 illustrates a front-side perspective view of an energy storage and release device according to one embodiment, where the device is in a first position.
Figure 4:
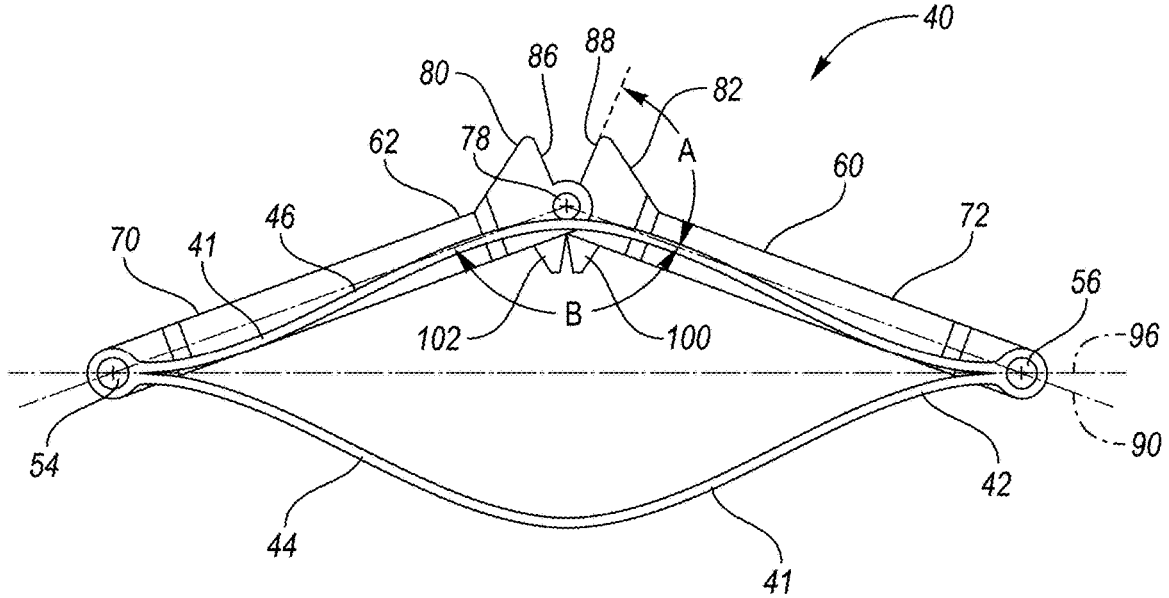
FIG. 4 illustrates a side perspective view of the energy storage and release device in FIG. 3, where the device is in the first position.

The connector 34 cooperates with the locking element 60 to compress the leaf springs 41 from the first unloaded position to the second loaded position when the energy capture mechanism 30 is deformed. For example, the locking element 60 can move from an locked position (as shown in FIGS. 1, 3, and 4) to a unlocked position (as shown in FIGS. 2, 7, and 8) to compress the leaf springs 41. When the force from the connector 34 is applied to the locking element 60, the locking element 60 is pulled to the locked position which causes the leaf springs 41 to compress to the second loaded position to store potential energy.

The locking element 60 includes an over-center linkage 62 connected to the leaf springs 41. The over-center linkage 62 is a bi-stable linkage that is stable in two positions, both in the unlocked position (FIGS. 1, 3 and 4) and the locked position (FIGS. 2, 7 and 8). Other locking elements 60 may include a latch, pawl, rachet, dead bolt, or other elements that hold energy in the storage element 42 and/or the energy storage and release device 40 until it is most advantageous to release the storage element 42 and return the stored energy to the wearer.

The over-center linkage 62 provides a mechanical advantage when transitioning between two stable positions. For example, it is easier to compress the linkage to move the linkage 62 into the over-center position, and once in that position, the mechanical advantage helps to keep the linkage 62 locked.

The linkage has two arms, a first arm 70 and a second arm 72. As shown in FIGS. 1-8, the first arm 70 maybe oriented as a forward arm and the second arm 72 is oriented as a rearward arm. The arms 70, 72 are connected at pivot points at each end of the linkage arms, at a first end 74 (e.g., a forward end) and a second end 76 (e.g., a rearward end). These pivot points 54, 56 allow the arms 70, 72 to rotate around a fixed axis 58. A central pivot point 78 connects the two arms 70, 72, allowing the arms to move together in a synchronized manner. As shown in FIGS. 3-8, the two arms 70, 72 may be symmetric mirror images about the central pivot point 78 and move symmetrically between the unlocked and locked position. However, the arms 70,72 can be different sizes or may be asymmetric about the pivot point 78. In various embodiments, the connector 34 may be attached at the central pivot point 78. For example, the connector 34 can be attached to the central pivot point 78 and move the locking element 60 from the unloaded position to the loaded position.

Figure 5:
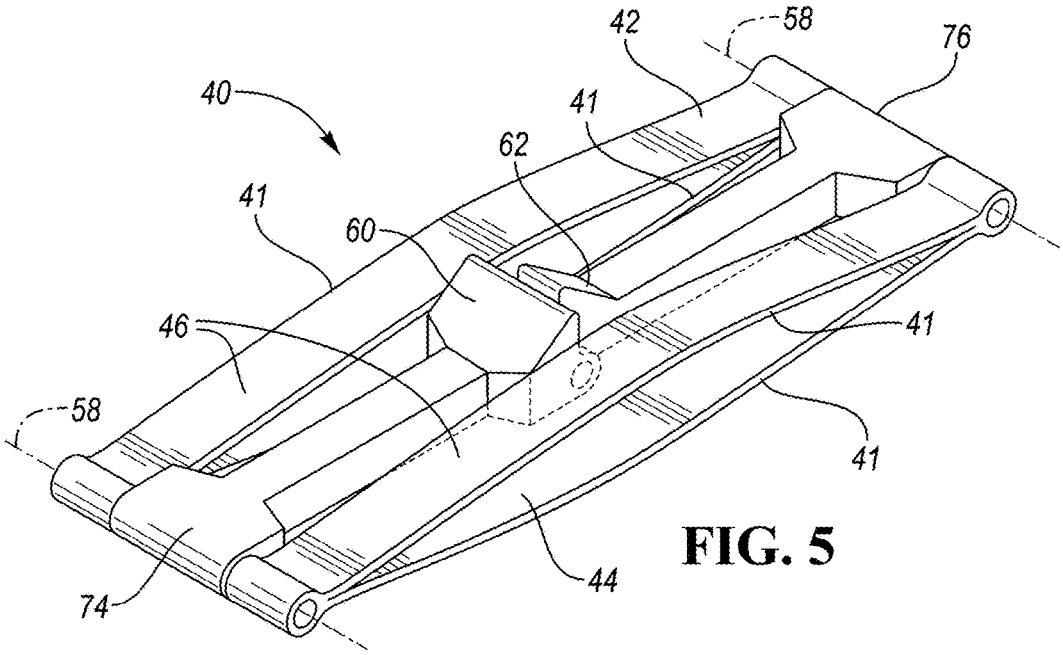
FIG. 5 illustrates a front-side perspective view of the energy storage and release device in FIG. 3, where the device is in an intermediate position.
Figure 6:
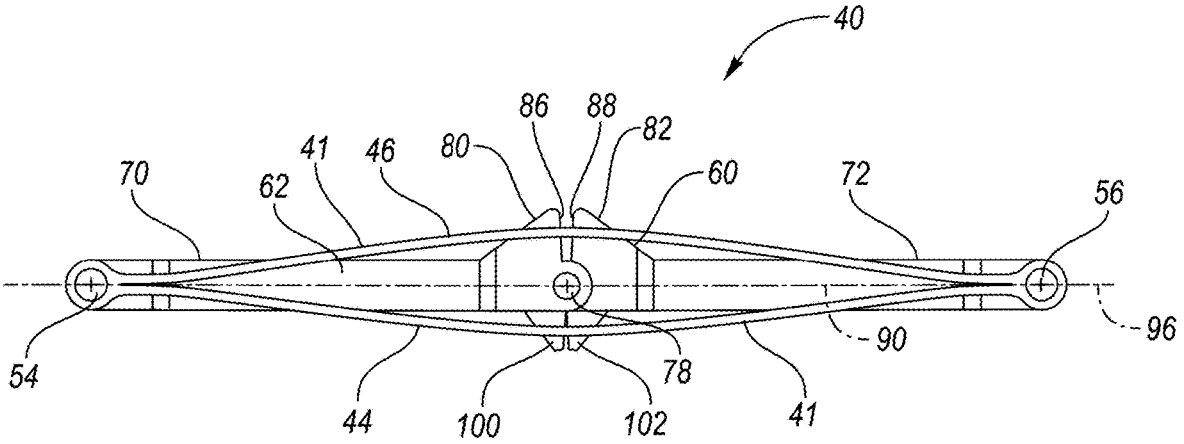
FIG. 6 illustrates a side perspective view of the energy storage and release device in FIG. 5, where the device is in the intermediate position.

The first and second arms 70, 72 include respective center ends 80, 82 adjacent the central pivot point 78. The center ends 80, 82 have angled abutment faces 86, 88. Each abutment face can have an angle A being less than 90-degrees relative to longitudinal axis of the respective arm 70, 72. For example, as shown in FIG. 4, the angle A may be between 80-85 degrees, however other angles are possible. The angle A helps define the over-center, locked position, as shown in FIG. 8, where the faces abut and prevent further rotation. The angle A allows clearance between the center ends 80, 82 at the center position, as shown in FIGS. 5-6. For example, if the angle A was greater than 90-degrees the abutment faces 86, 88 would be touching when the first and second arms 70, 72 are at the center position.

In the center position in FIGS. 5-6, the longitudinal axis of each arm 70, 72 is generally aligned. As the over-center linkage 62 moves to the locked position, the longitudinal axis of each arm 70, 72 are oriented at angle B that is greater than 180-degrees.

A trigger 100 is connected to the locking element 60. The trigger 100 may be connected to the over-center linkage 62, where actuation of the trigger releases the over-center linkage to the unlocked position and allows the storage element 42 to move to the first expanded position and thereby return stored energy to the wearer. Actuation of the trigger 100 may be based on a wearer input. The trigger 100 may include a protrusion 102 extending from at least one of the first and second arms 70, 72. The protrusion 102 may extend through the outsole 18 of the sole structure 12 when in the locked position. The protrusion 102 may be pushed by the ground, which then pushes the over-center linkage 62 out of the over-center position in FIG. 8 to the at-center position like in FIG. 6.

The protrusion 102 may be sized and positioned to actuate the over-center linkage 62 based on input from the wearer such as a specific foot angle, a bending angle of a portion of the wearer's foot, an engagement time or an engagement load, or other inputs. Once the trigger 100 is activated, the locking element 60 is released, and the energy storage element 42 will transfer the stored energy to the athlete by extending the midsole at the forefoot or forcing plantar flexion of the forefoot, midfoot, or shoe, for example.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A sole structure for a shoe, comprising:

an energy capture mechanism positioned in a heel region and elastically deformable under pressure of a heel-strike by the wearer;

a connector extending from the energy capture mechanism to translate the energy captured in the heel region;

an energy storage and release device positioned in a forefoot region and connected to the connector, the energy storage and release device comprising:

a leaf spring assembly movable between a first expanded position and a second compressed position; and an over-center linkage connected to the leaf spring assembly and the linkage movable between an unlocked position and a locked position in which linkage arms are positioned over-center, wherein the over-center linkage moves the leaf spring assembly to the compressed position as linkage is moved to the locked position; and a trigger connected to the over-center linkage, wherein actuation of the trigger based on a wearer input releases the over-center linkage to the unlocked position and allows the leaf spring assembly to move to the first expanded position and thereby return stored energy to the wearer.

2. The sole structure according to claim 1, wherein the leaf spring assembly comprises a pair of leaf springs are oriented opposite and flexed apart in the expanded position and compress towards each other in the second compressed position.

3. The sole structure according to claim 1, wherein the over-center linkage comprises a first linkage arm connected to pivot at a first end of the leaf spring assembly, and a second linkage arm is connected to pivot at the second end of the leaf spring assembly, wherein the first and second linkage arms abut at center ends when in the locked position.

4. The sole structure according to claim 3, wherein the center ends of the first and center linkage arms have an angled abutment face that has an angle being less than 90-degrees relative to a longitudinal axis of the first and second linkage arms.

5. A sole structure of a shoe comprising:

an energy capture mechanism positioned in a first midsole region and elastically deformable under the pressure of a foot-strike by the wearer;

an energy storage and release device positioned in a second midsole region and connected to the energy capture device, the energy storage and release device comprising:

a storage element movable comprising at least one spring and between a first unloaded position and a second loaded position; and a locking element cooperating with the storage element to lock the storage element in the second loaded position, and wherein actuation of the locking element based on a wearer input releases the storage element to return stored energy to the wearer.

6. The sole structure according to claim 5, wherein the spring comprises a pair of leaf springs, wherein the pair of leaf springs are joined at each of two ends.

7. The sole structure according to claim 6, further comprising two pairs of leaf springs.

8. The sole structure according to claim 5, wherein the locking element comprises an over-center linkage.

9. The sole structure according to claim 8, wherein the over-center linkage comprises a pair of arms connected to pivot relative to each other, wherein the pair of arms pivot to an over-center locked position to maintain the storage element in the second loaded position, wherein in the locked position, a longitudinal axis of the arms are oriented at an angle greater than 180-degrees.

10. The sole structure according to claim 6, wherein the locking element comprises an over-center linkage having a pair of linkage arms, wherein the linkage arms and the leaf springs rotate about a common pivot point axis at ends, and wherein the first and second linkage arms are connected at a central-pivot point adjacent the center ends and oriented as mirror images.

11. The sole structure according to claim 9, wherein the pair of linkage arms are shorter than a length of the leaf spring.

12. The sole structure according to claim 5, wherein the locking element comprises a trigger element that is actuated by an input from the wearer.

13. The sole structure according to claim 12, wherein the trigger element comprises a protrusion extending from at least one of the first and second linkage arm.

14. The sole structure according to claim 13, wherein the protrusion extends through an outsole of the sole structure to contact the ground and actuate the locking element based on input by the wearer.

15. The sole structure according to claim 12, wherein the trigger element moves the locking element from the locked position to an unlocked position based on input from the wearer.

16. The sole structure according to claim 12, wherein the input from the wearer comprises at least one of a foot angle, a bending angle of a portion of the wearer's foot, an engagement time or an engagement time.

17. The sole structure according to claim 12, wherein when the trigger element is actuated, the storage element is moved to the first unloaded position, transferring the energy to the wearer.

18. The sole structure according to claim 5, further comprising a connector extending from the energy capture mechanism element to translate the energy captured in the first midsole region, wherein the connector comprises a cable extending between the energy capture device in the first midsole region and the locking element in the second midsole region.

19. A sole structure having an energy storage and release device comprising:

a leaf spring assembly movable between a first unloaded position and a second loaded position positioned in a forefoot region; and a locking linkage cooperating with the leaf spring assembly to lock the leaf spring assembly in the second loaded position, wherein the locking linkage cooperates with the leaf spring assembly so as the locking linkage is moved to a locked position, the leaf spring assembly is moved to the second loaded position; and a trigger connected to the locking linkage, wherein actuation of the locking linkage based on a wearer input releases the locking linkage to an unlocked position and allows the leaf spring assembly to move to the first unloaded position and thereby return stored energy to the wearer.

20. The sole structure according to claim 5, wherein the first midsole region comprises a heel region and the second midsole region comprises a forefoot region.

* * * * *